United States Patent [19]

Ryan et al.

[11] 3,968,673

[45] July 13, 1976

[54] METHOD AND APPARATUS FOR PRODUCING STEEL BOX TOES TO BE USED IN SAFETY SHOES

[75] Inventors: William H. Ryan, Boca Raton, Fla.; Norman H. Evers, West Natick, Mass.

[73] Assignee: William H. Ryan, Boca Raton, Fla.

[22] Filed: Apr. 25, 1975

[21] Appl. No.: 571,624

[52] U.S. Cl. ..... 72/331; 113/116 BB; 29/414

[51] Int. Cl.[2] ..... B21D 28/06; B21D 31/00

[58] Field of Search ..... 72/326, 325, 324, 331, 72/338, 328, 330; 29/DIG. 9, 414; 83/622, 620, 914, 621; 113/116 V, 116 BB

[56] References Cited

UNITED STATES PATENTS

| | | | |
|---|---|---|---|
| 2,321,085 | 6/1943 | Hubbard | 72/327 |
| 2,377,664 | 6/1945 | Berger | 72/325 X |
| 2,615,111 | 10/1952 | Paquette et al. | 83/914 X |
| 3,009,504 | 11/1961 | Myers et al. | 72/330 |
| 3,448,648 | 6/1969 | Magruder et al. | 83/914 X |
| 3,461,756 | 8/1969 | Mojonnier | 83/914 X |

*Primary Examiner*—Milton S. Mehr
*Attorney, Agent, or Firm*—Munroe H. Hamilton

[57] ABSTRACT

A flat strip of metal, preferably coiled upon itself, is fed into a draw press and subjected to pressure to produce a generally bowl-shaped workpiece having irregular outer edges within which is defined a pair of mirror-imaged toe cap parts. The toe cap parts occur in angularly opposed relation to one another and are surrounded by irregular edge portions. The toe cap parts are separated and gauged by a press operation in which parting is combined with a trimming operation in a unique manner. An improved tool construction for processing the workpiece includes mating die bodies which are progressively moved toward one another in contact with the workpiece. During a first movement inner sides of the toe cap parts are located in a centered position on one of the mating die parts. Further die movement operates to separate the toe cap parts. Completion of the die motion trims away irregular outer edges of each toe cap part and simultaneously die cut edges of the toe cap parts are conformed to a desired shape.

20 Claims, 24 Drawing Figures

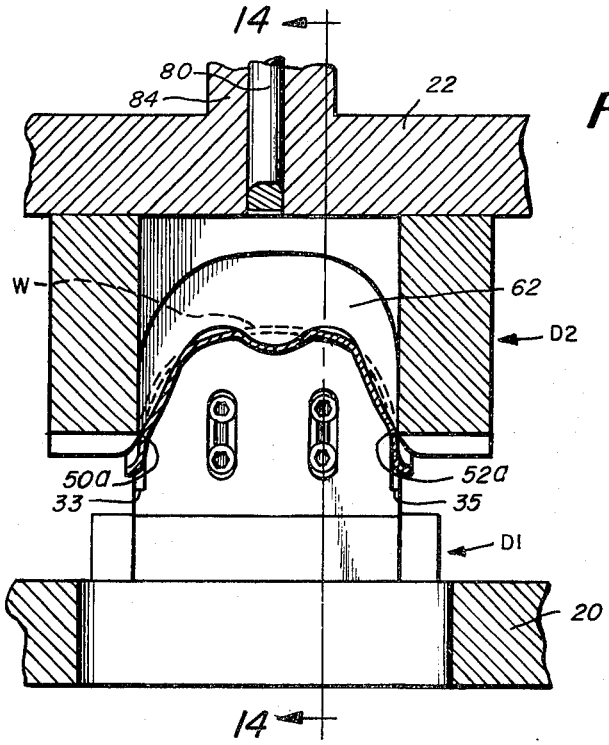
FIG. 13
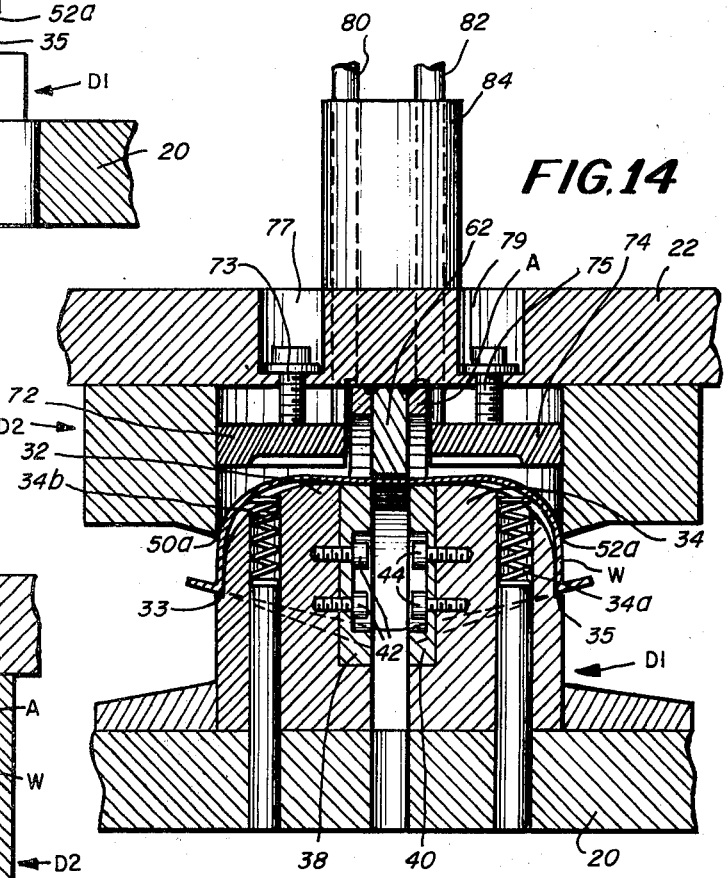
FIG. 14
FIG. 15
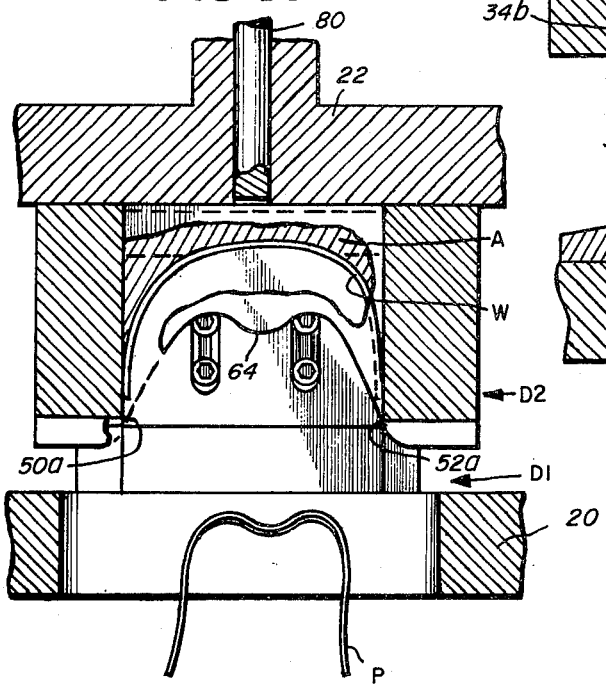

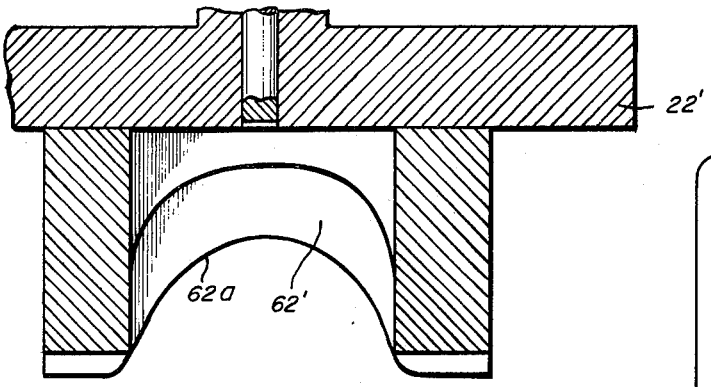
FIG. 17
FIG. 18
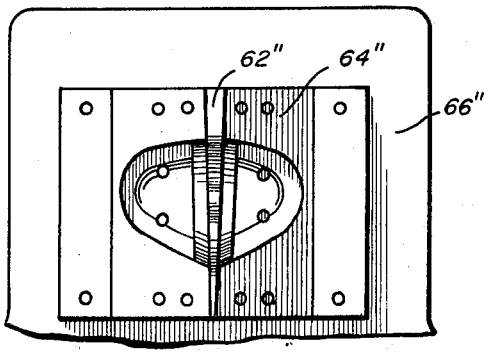
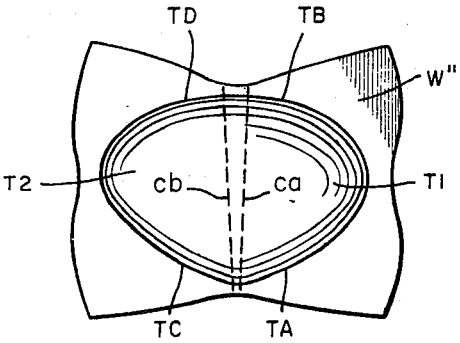
FIG. 20
FIG. 19
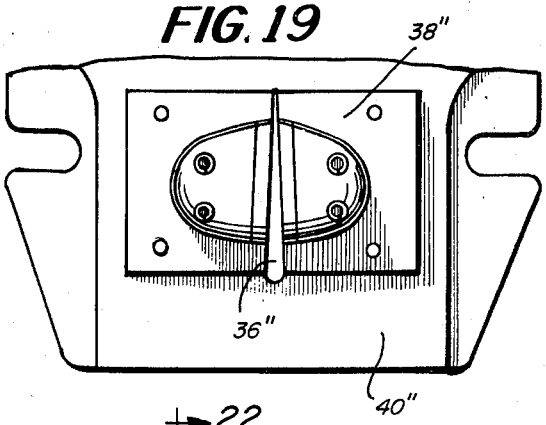
FIG. 22
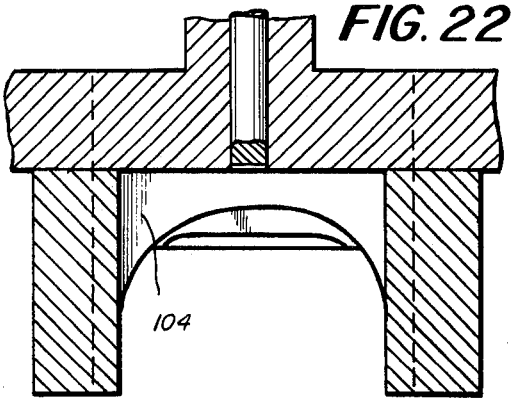
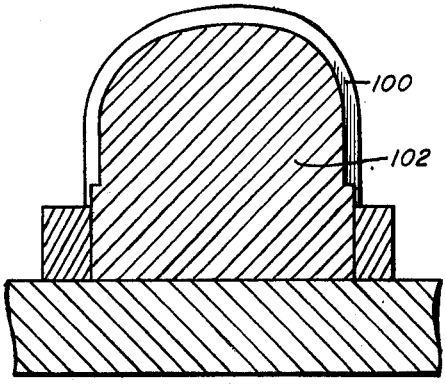
FIG. 21
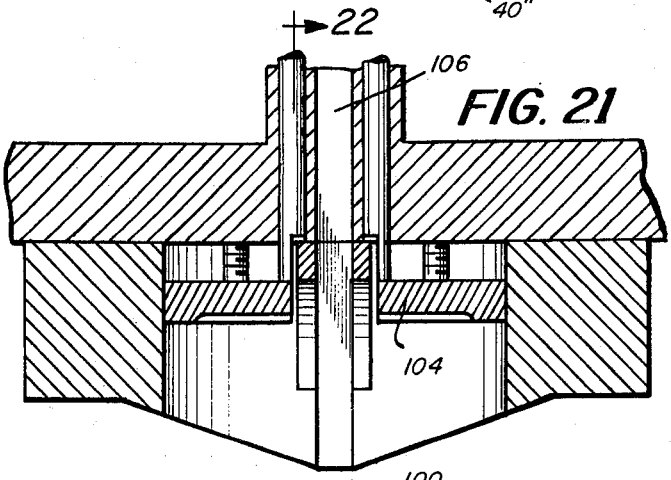
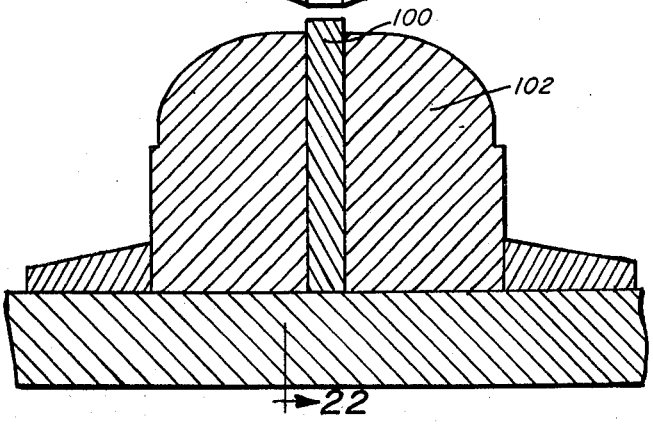

METHOD AND APPARATUS FOR PRODUCING STEEL BOX TOES TO BE USED IN SAFETY SHOES

BACKGROUND OF THE INVENTION

In the art of making steel box toes for safety shoes, it has been customary to utilize a sheet or strip of steel which is subjected to a series of stamping and cutting operations. These include pressing the metal into a bowl-shaped workpiece in a draw press; trimming excess material around the bowl-shaped workpiece; parting the workpiece to form left and right toe cap parts; and finally, forming last-engaging flanges on the bottom edges of each of the separated toe cap parts. Drawing and trimming are usually combined in a single press with excess material being cut or pinched off. A variation of this method is to cut a blank in outline and subsequently press the blank to form a desired bowl shape.

Each of these methods which combine parting and trimming are objectionable for one reason or another. Thus cutting an outline of sheet material and forming the blank requires a larger area of flat stock and uses a greater weight of steel than that utilized where the stock is first drawn and then trimmed. However, in order to draw and then trim the follow-through motion of the die punch and the fit of the die punch with its mating die part must be very precise. Also since the drawing and trimming must be done in powerful presses and the workpiece is eccentric and irregular in shape, damage to tool parts can easily occur if too much pressure is used. If too little pressure is utilized, trimming may not occur uniformly.

A further complication arises in making a more recent style of toe cap having a "wing-back" or "wing-guard" shape. This stype of toe cap provides additional protection to the sides of the front. A pressed bowl shape, instead of being cut to form caps whose back edges are in essentially vertical lines, is cut at an angle so that metal extends along the bottom edge of the shoe for a distance greater than it does at the top. To produce toe cap parts having the wing-guard shape, it has been proposed to make the bowl-shaped workpiece with two lobes which extend in angularly opposed relation to one another. When this shape is parted by a straight cut, and the separated lobes are rotated so that their long sides are in an essentially horizontal position, it will be seen that the straight cut now assumes an inclined position extending from the top rearwardly to the back of the top cap at its lower edge, as desired. When forming a bowl-shape having the lobes described, there is, however, a tendency for metal to become stretched along the shortest and straightest line between the lobes with some imprecision occurring. Toe cap edges cut through the imprecise central section of the stretched lobes may require reshaping and use of a separate press operation.

SUMMARY OF THE INVENTION

The present invention relates to an improved method of making steel box toes for safety shoes in which trimming of a bowl-shaped workpiece is not done in conjunction with a drawing operation, nor separately, but rather is combined with a parting operation in a manner such that a single tool may be utilized having one continuous operating motion.

In thus processing a draw workpiece by combining a parting step with a subsequent trimming operation, an important objective is to simplify the bowl-shape drawing operation so that less pressure is required and presses of lighter tonnage may be utilized. Another object is to reduce wear and to improve reliability of the overall process. Still another object is to devise a method which utilizes a minimum amount of metal and which operates in a manner such that errors in the exact shape of the toe cap parts may be corrected. Still another object of the invention is to provide a method involving a series of operations capable of being carried out with presses which are of relatively light tonnage and which are readily adaptable to automatic production processing.

In realizing these various objectives, we have devised an improved method and apparatus which is bssed essentially on the concept of subjecting a previously drawn workpiece to a series of process steps which can be progressively carried out in a single continuous motion die apparatus.

In this continuous motion die apparatus, a novel parting blade assembly for separating the workpiece into a pair of toe cap parts is combined with trimming means for cutting away outer edge portions of the workpiece at a point at which separation of the toe cap parts is nearing completion. The parting blade assembly in its preferred form provides a shearing cut along spaced apart lines of cutting and a strip or connecting web portion is removed from the workpiece.

We have determined that the power required to thus cut along two spaced apart lines of cutting in a bowl-shaped workpiece is substantially less than the power required for both drawing and parting in a conventional type press. Moreover, we find that the power for operating the parting blade assembly is adequate for carrying out a trimming operation in the same die movement, and at a point where the parting blade is nearing the end of its stroke.

We have also determined that we may achieve a saving in the amount of metal customarily required in a conventional press for carrying out both drawing and trimming. For example, when a conventional draw press is employed, it is customary to hold the excess metal at all points around the bowl-shaped workpiece, and an average minimum width of metal so held is approximately one-quarter of an inch wide at the closest point.

In our improved method of parting and then trimming, it is undesirable and unnecessary to have the quarter-inch flange specified above. It becomes possible, therefore, to reduce the width of the stock utilized by one-half inch or more throughout its entire length, thereby effecting overall savings of approximately ten per cent or more in total steel required.

The nature of the invention and its other objects and novel features will be more fully understood an appreciated from the following description of a preferred embodiment of the invention selected for purposes of illustration and shown in the accompanying drawings.

BRIEF DESCRIPTION OF THE DRAWINGS

FIG. 13 is a vertical cross sectional view further illustrating the die parts in a position in which cutting has been initiated.

FIG. 14 is a cross section taken approximately on the line 14—14 of FIG. 13.

FIG. 15 is a vertical cross section showing the die parts with cutting completed and gauging surfaces meeting.

FIGS. 17—22 illustrates modified forms of parting blade construction for combining a parting operation with a trimming step.

DESCRIPTION OF PREFERRED EMBODIMENT OF THE INVENTION

The present invention is concerned with an improved method of processing a drawn bowl-shaped workpiece, and is in general based upon the concept of combining in one continuous die movement a parting operation with a trimming step.

As one practical means of combining a parting operation with a trimming step, there has been devised a pair of specially formed mating die bodies which are so constructed and combined with one another as to require greatly reduced pressures and hence use of presses of relatively smaller tonnage.

Figure 1:
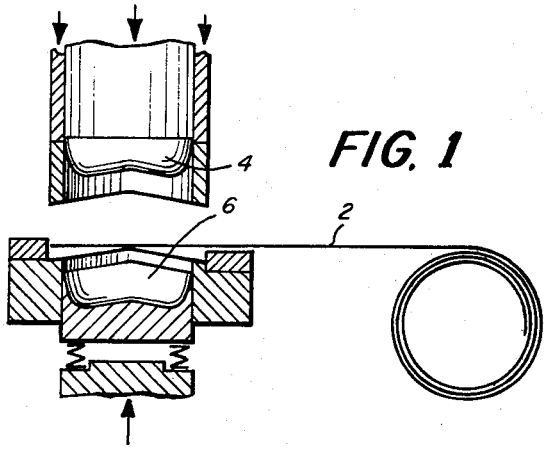
FIG. 1 is a diagrammatic view illustrating a step of feeding a strip of metal into a die apparatus to form a generally bowl-shaped workpiece.
Figure 2:
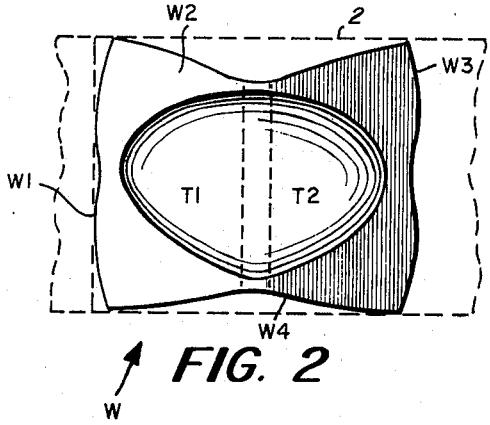
FIG. 2 is a diagrammatic view illustrating a bowl-shaped workpiece as produced by the step of FIG. 1.
Figure 3:
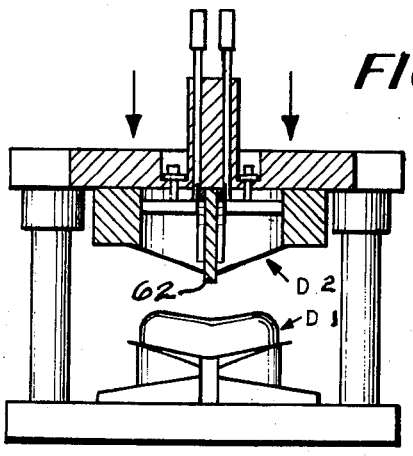
FIG. 3 is a diagrammatic view illustrating another die apparatus for producing separated toe cap parts from a bowl-shaped workpiece of the class shown in FIG. 2.
Figure 4:
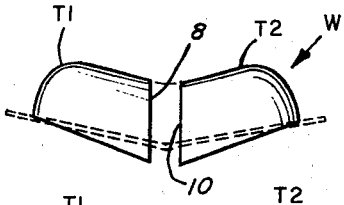
FIGS. 4 an 4*a* are elevational and plan views, respectively, of the cap parts formed in the apparatus of FIG. 3.
Figure 4A:
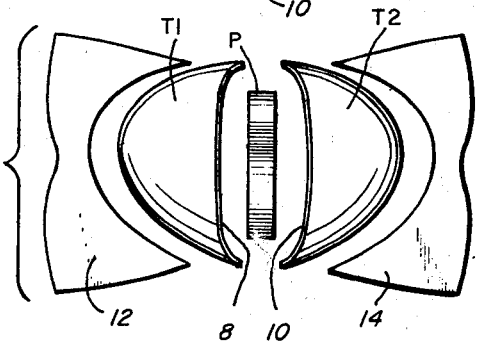
Figure 5:
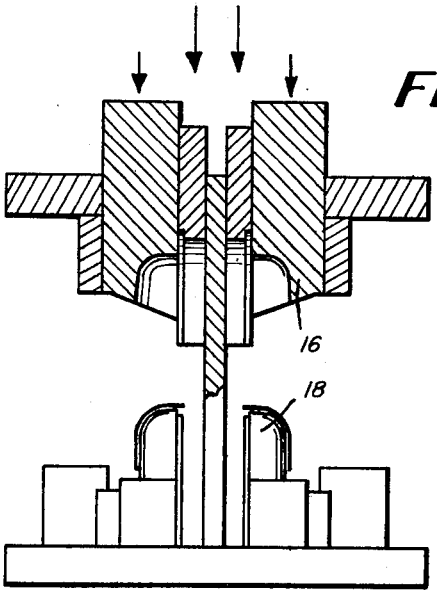
FIG. 5 is a diagrammatic view of another die apparatus for forming flanged edges on toe cap parts as shown in FIGS. 4 and 4*a*.

In the drawings, FIGS. 1 and 2 illustrate diagrammatically drawing a sheet material to provide a bowl-shaped workpiece. FIGS. 3, 4 and 4*a* illustrate diagrammatically the steps of parting and trimming as noted above and FIGS. 5 and 6 illustrate diagrammatically forming the toe cap parts with flanged edges. The remaining FIGS. 7 to 22, inclusive, illustrate in more detail the parting and trimming operations indicated schematically in FIG. 3, together with apparatus devised for carrying out these operations in a novel manner.

Considering these Figures in more detail and with particular reference to FIGS. 1 and 2, numeral 2 denotes a sheet material which preferably may consist in a coiled strip of steel having a formulation such that after heat treatment it will have a hardness consistent with Federally regulated specifications for box toe rigidity when installed in safety shoes. The strip of steel is periodically advanced into a reciprocating press which includes an upper die part 4 and a lower die part 6 of conventional construction. The sheet material is drawn and secured in this reciprocating press to provide a bowl-shaped workpiece which is denoted by the arrow W and indicated schematically in FIG. 2. In this workpiece are defined two toe cap parts T1 and T2 which are mirror-images of one another and which occur in angularly opposed relationship. The toe cap parts T1 and T2, thus defined, are also surrounded by irregular edges W1, W2, W3 and W4.

Figure 6:
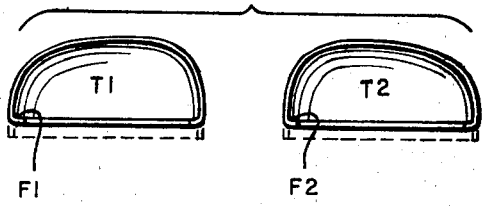
FIG. 6 illustrates diagrammatically toe cap parts with flanged edges formed therein.
Figure 7:
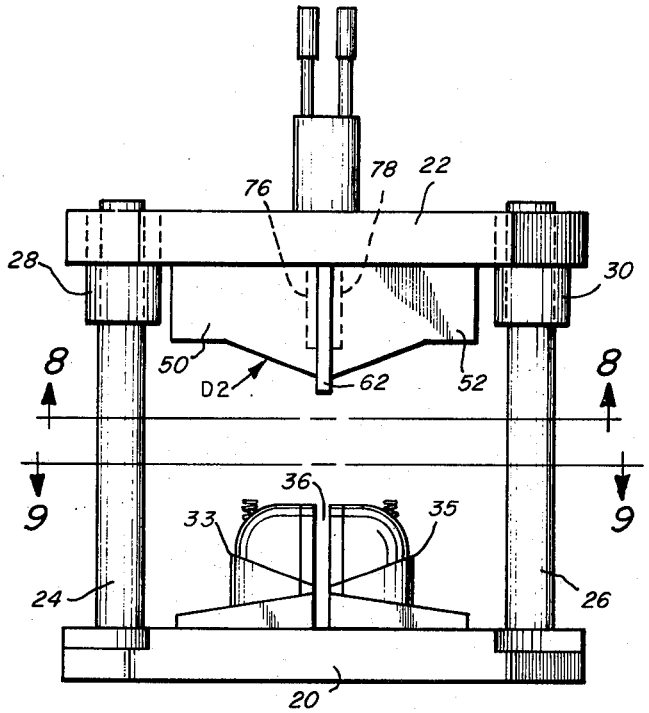
FIG. 7 is an elevational view illustrating in further detail die apparatus shown in FIG. 3.

In accordance with the invention, we provide mating die parts D1 and D2 which are mounted in respective frame parts 20 and 22 of a reciprocating press as shown in FIG. 7. A workpiece W is supported between die parts D1 and D2 in a centered position and is then subjected to a continuous die cutting operation to carry out in rapid succession parting and trimming steps. In this preferred die cutting operation, a connecting web portion 12 is removed from the workpiece and the toe cap parts T1 and T2 are separated so as to provide rearwardly angled cut edges 8 and 10. At the same time scrap material portions 12 and 14 are trimmed away as suggested diagrammatically in FIGS. 4 and 4*a*. Thereafter, the separated toe cap parts T1 and T2 are subjected to another press operation between die parts 16 and 18 to provide flanged edges F1 and F2, as illustrated in FIG. 6.

As noted earlier, the mating die parts D1 and D2, employed in carrying out the continuous die processing operation of the invention, generally include as principal parts thereof a parting blade assembly for separating a workpiece into a pair of toe cap parts and trimming means for cutting away outer edges of the workpiece at a point when separating of the toe cap parts is nearing completion. There may also be provided gauging means for reshaping the cut edges of the top cap parts at the end of the die movement where this is required.

The parting blade assembly comprises a specially formed parting blade member in die D2 and a parting blade aperture located in the die body D1 in a position to cooperate with the parting blade member in carrying out a shearing cut which preferably proceeds along two spaced apart lines of cutting. The trimming means includes a continuous shearing edge located around the base of the die body D1 which receives the toe cap portions as they are being separated, and combined with this shearing edge is a second shearing edge extending continuously around the outer side of the die body D2 for engaging and cutting irregular edge portions located around the toe cap parts.

The gauging means above noted comprises gauging surfaces located at either side of the parting blade aperture in the die body D1 in a position to receive thereagainst cut edges of toe caps which may be of imprecise shape. Cooperating with these gauging surfaces are special gauging elements combined with the parting blade member at either side thereof in such relation as to contact imprecise cut edges as trimming is being completed and to compress and reshape the imprecise cut edges in a desired form.

Figure 8:
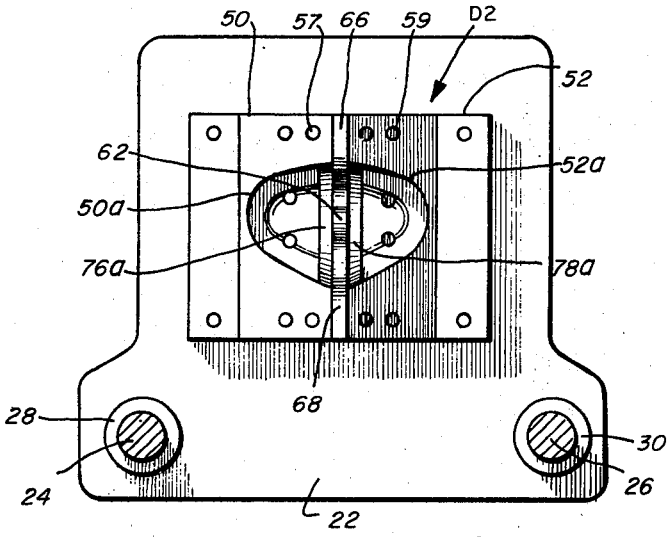
FIG. 8 is a cross section taken on the line 8—8 of FIG. 7.
Figure 9:
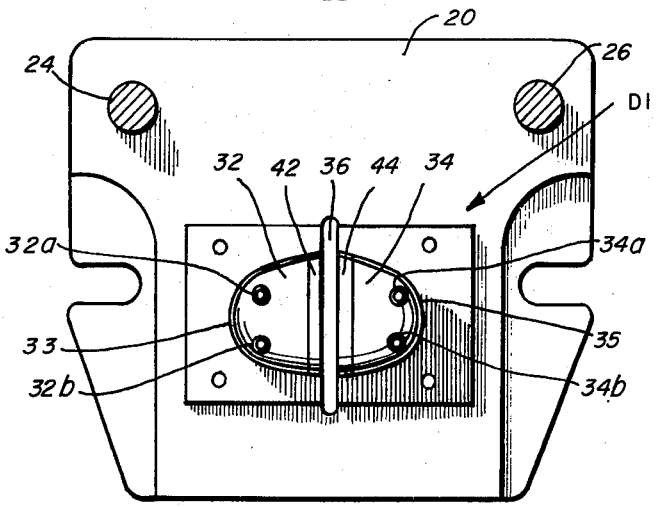
FIG. 9 is a cross section taken on the line 9—9 of FIG. 7.

Referring in more detail to the mating die parts, D1 and D2, and their operation as illustrated in FIGS. 7 to 16, inclusive, numeral 20 indicates a lower frame member in which is mounted the die body D1 as shown in FIGS. 7 and 9. Numeral 22 indicates an upper frame member in which is received the die body D2 as illustrated in FIG. 7 as well as in FIG. 8. Supported in the lower frame member 20 are posts 24 and 26 which are arranged to be slidably received in the sleeve portions 28 and 30 mounted in the frame member 22. The posts 24 and 26 and their respective sleeves function to hold the die bodies D1 and D2 in registered relationship with one another when movement of one of the die bodies in relation to the other takes place.

It will be understood that in a preferred embodiment of the invention, the frame members 20 and 22 are utilized with a reciprocating press of conventional nature which operates to support the die body D1 in a stationary position and to move the die body D2 vertically toward and away from the die body D1. However, it is intended that movement of the die bodies may be varied with either die body being movable and the other stationary and the direction of travel may be horizontal or otherwise, if desired.

Figure 10:
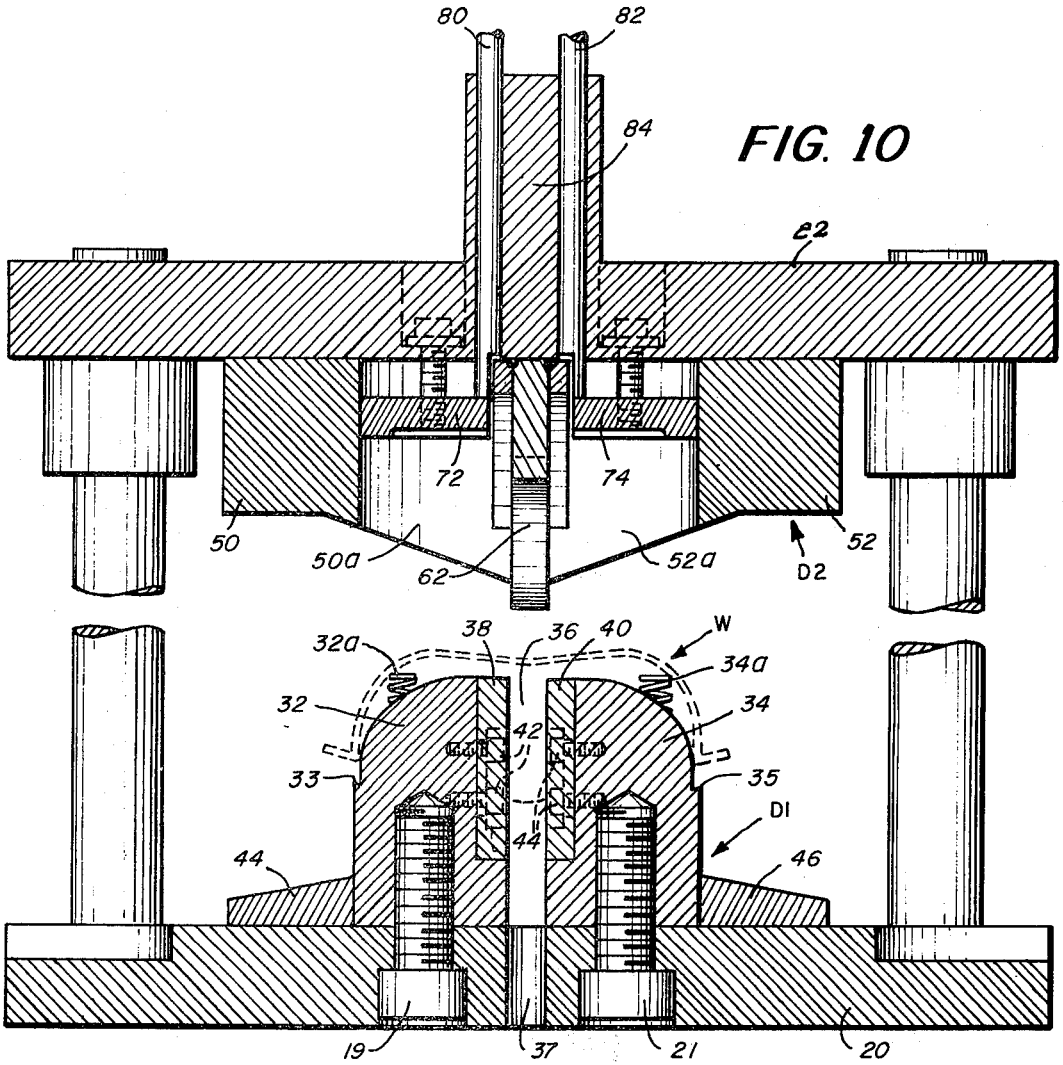
FIG. 10 is a vertical cross section taken centrally of the die apparatus shown in FIG. 7.

In the preferred embodiment of the invention noted above, the lower die body D1 includes a pair of generally cup-shaped portions 32 and 34 which may be secured to the frame member 20 by means of fastenings as 19 and 21, shown in FIG. 10. These cup-shaped portions 32 and 34 are formed with convex surfaces which are designed to mate with and support thereon inner concaved sides of a workpiece having a shape such as the workpiece W, shown in FIG. 2.

Mounted in the cup-shaped portions are springs 32*a*, 32*b*, 34*a* and 34*b*, as shown in FIG. 10. At a point at which the workpiece is cut, separated toe cap portions may be forced upwardly by the springs, as hereinafter noted in more detail.

Located medially between the cup-shaped portions 32 and 34 is a parting blade aperture 36 which communicates with a corresponding aperture 37 in the frame member 20. Also provided in the cup-shaped members 32 and 34, in recessed relationship therewith, are shearing elements 38 and 40 secured by fastenings as 42, 44, etc. The shearing elements 38 and 40 are formed of hardened steel and comprise a pair of spaced apart shearing edges. In addition, the upper surfaces 42 and 44 of the shearing elements 38 and 40 are constructed with gauging surfaces which are designed to support cut edges of separated toe cap parts thereon. At either side of the members 32 and 34 are based portions 44 and 46 having angularly extending surface which are designed to receive trimmed scrap material and deflect them downwardly into discharge outlets.

Formed around outer sides of the cup shaped portions 32 and 34 immediately above the base portions 44 and 46 are lower recessed trimming edges 33 and 35 which are designed to receive thereagainst projecting edges of the workpiece W during movement of the die bodies toward one another.

Figure 16:
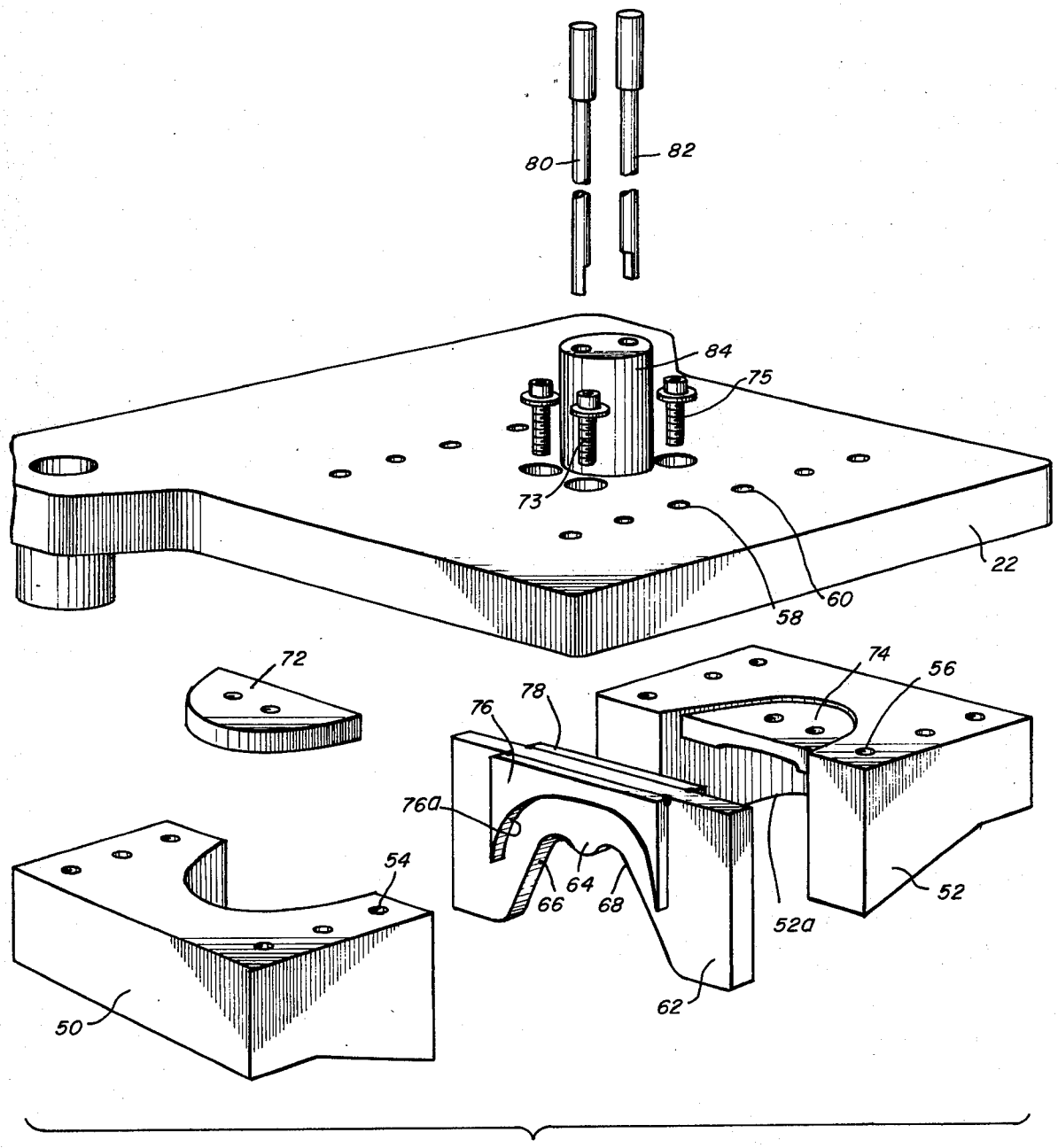
FIG. 16 is an exploded perspective view of one of the die bodies illustrated in FIG. 8.

The die body D2 constructed to mate with the die body D1 above described is secured at the underside of the frame part 22 as shown in the preferred embodiment in the drawings and generally includes a number of components which are most clearly shown in FIG. 16. Included therein are a pair of die sections 50 and 52, a parting blade member 62, ejector blades 72 and 74 and gauging elements 76 and 78. The die sections 50 and 52 are fastened by bolts or other fastening means indicated in FIG. 8 by numerals 57 and 59 and being located through holes as 54 and 56 in alignment with corresponding holes as 58 and 60 in the frame 22.

The parting blade 62 is secured to the underside of the frame 22, for example, by welding, as shown in FIG. 14, and the gauging elements 76 and 78 are similarly welded to the parting blade member 62. The configuration of the parting blade 62 may be of a shape such that it serves as a means of engaging and precisely locating a workpiece on the convex surface of the die part D1 before cutting takes place. The shape of the blade may also be varied to control the way in which cutting is initiated and the pressure required to separate the workpiece. In one simple form, the blade shape may be designed to contact the workpiece on two opposite sides thereof. In another desirable form the blade shape may be designed to contact the workpiece on two opposite sides and also at an upper central section thereof. FIGS. 7 to 16 illustrate a parting blade construction for engaging against a workpiece at three points, while FIG. 17 illustrates a parting blade shape for engaging against two opposite sides only of a workpiece. The thickness of the parting blade may also vary and in one form, may consist in a relatively sharp edge member. In another desirable form, the blade may have an appreciable thickness, as illustrated in FIGS. 7 to 16. In still another form, the blade may have a varying thickness as shown in FIGS. 18, 19 and 20.

In the blade construction shown in FIGS. 7 to 16, the underside of member 62 is constructed with reversely curved cutter edges which define a projecting cutting section 64 and relieved cutter sections 66 and 68 extending away from the central cutter section at either side thereof. The parting blade member 62 may also be constructed with an appreciable thickness to provide shearing edges which are spaced apart with a spacing chosen with reference to the spacing between the shearing elements 38 and 40 in die body D1. This arrangement provides for the shearing edges of the parting blade slidably engaging with edges of the shearing elements 38 and 40 in a scissor-like manner which reduces pressure requirements. Moreover, cutting when initiated at two or more points of contact proceeds progressively so that less pressure is required to be exerted by the press than would be required where cutting takes place at all points along the surface of the workpiece simultaneously.

A further important feature of the parting blade construction disclosed is the shape and arrangement of the gauging elements 76 and 78 for gauging reshaped toe cap parts whose cutting edges may be slightly imprecise. As is most clearly shown in FIG. 16, these gauging elements 76 and 78 are secured at either side of the parting blade 62 and present curved gauging surfaces 76*a* and 78*a*, one of which, 76*a*, is indicated in FIG. 16. These curved gauging surfaces are formed of a concavity complementary with the shape of the gauging surfaces 42 and 44 and the gauging elements 38 and 40, and are designed to reshape cut edges to conform to a predetermined last shape over which the box toes are to be mounted. By locating these edges in suitably spaced relation to the parting blade, the timing of the reshaping movement is controlled so as to occur at the point where the cutting blade has nearly finished its cut and each toe cap part may be separately compressed and reshaped.

As will be observed from an inspection of FIG. 16, the two die sections 50 and 52 are recessed to form cup-shaped openings of a size suitable for overlying the toe cap parts T1 and T2 in the workpiece W, and the bottoms of these recessed openings terminate in trimming edges 50*a* and 52*a*, most clearly shown in FIG. 8. The ejector blades 72 and 74 are slidably received in the cup-shaped openings and are attached to lower ends of holding bolts as 73 and 75, etc., which are free to rise in recesses as 77 and 79 in frame 22 when the ejector blades are moved upwardly. Pins 80 and 82 are slidably received in a cylindrical guide part 84 at the top of frame 22. At their lower end, the pins 80 and 82 are relieved to provide depending flat extremities movably between respective gauging elements 76 and 78 and adjacent die surfaces as shown in FIGS. 10 and 14. When upper ends of the pins 80 and 82 contact stop surfaces in a press member, they operate to force the ejector blades downwardly to eject toe cap parts in the cup-shaped openings of the die sections 50 and 52.

In utilizing the apparatus above described for forming toe cap parts, a workpiece W of the shape described is placed in a press in which is mounted the die body D1 with the die body D2 in a raised position as shown in FIG. 10. The workpiece W is yieldably received against springs 32*a*, 32*b*, 34*a* and 34*b* in the convex surfaces of the die sections 32 and 34. These springs are indicated in FIG. 9 and two of them are shown in FIG. 14.

Figure 11A:
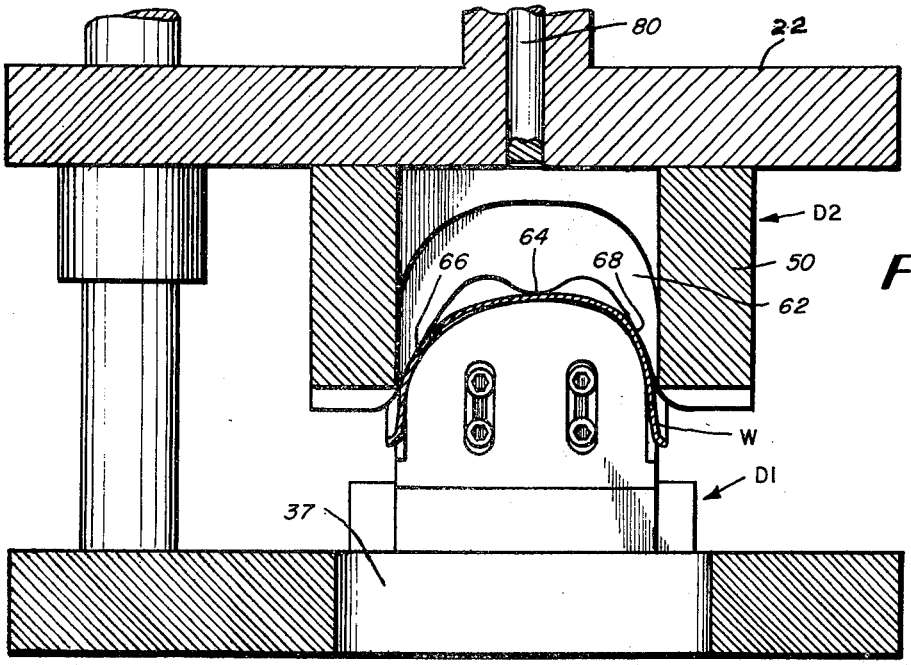
FIG. 11a is a cross section taken on the line 11*a*—11*a* of FIG. 11.
Figure 11:
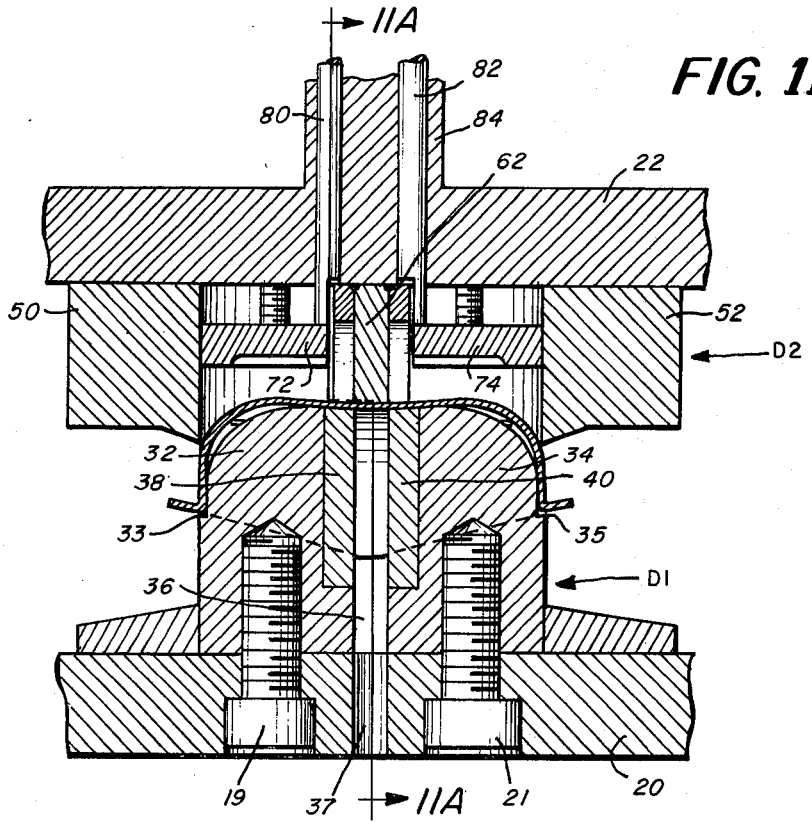
FIG. 11 is a vertical cross section showing die parts making a three-point contact with the workpiece.
Figure 12:
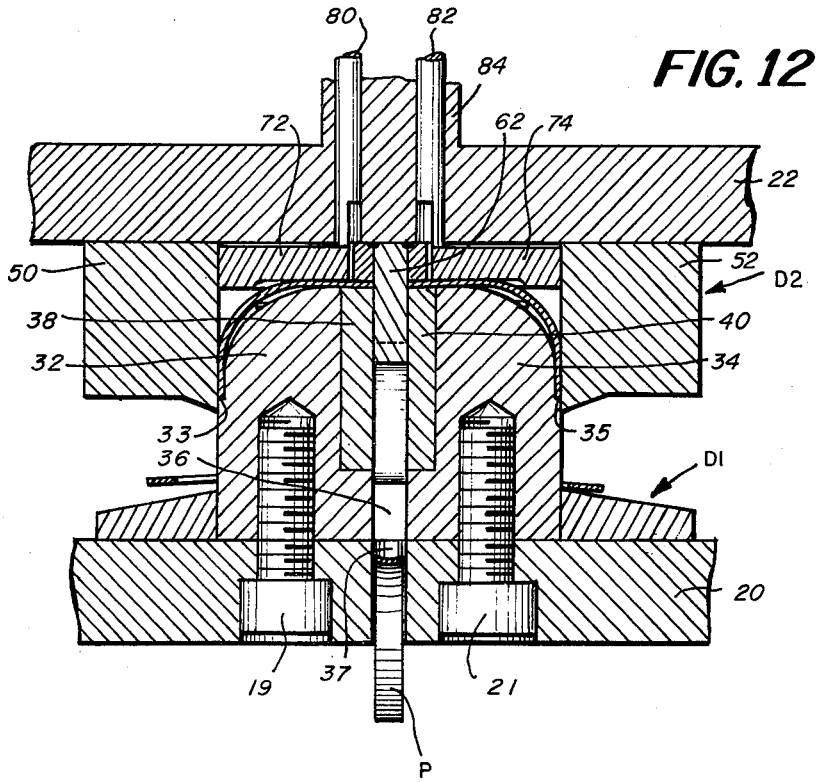
FIG. 12 is a vertical cross section similar to FIG. 11*a* but further indicating cutting of the workpiece being completed.

After the operator has placed the workpiece in the press, as described, the upper die body is actuated and moved downwardly with the parting blade 62 engaging the workpiece at three spaced apart points of contact in a manner such that the workpiece is forced down into contact with the convex surfaces of the die sections 33 and 34 and as a result of this three-point contact, the workpiece becomes correctly centered and held against rocking or other minor displacement. FIG. 11*a* is intended to illustrate this first point of contact of the parting blade with the workpiece.

Thereafter, pressure is exerted on the die body D2 and as this occurs, the parting blade projecting portion 64 and relieved sides 66 and 68 start to shear the workpiece as suggested in FIGS. 13 and 14. Further movement of the die body D2 downwardly completes the cutting action of the parting blade and as this takes place, the two sets of trimming edges 50*a* and 52*a* moves against the workpiece edges lying on trimming means 33 and 35 and trimming takes place with scrap material falling against the inclined surfaces of the members 44 and 46, as shown in FIG. 10. A connecting web portion P of the workpiece becomes cut out and curled into a shape which is readily discharged down through the parting blade aperture and out of the bottom aperture 37 of the base 20, as suggested in FIGS. 12 and 15.

It will be understood that the toe cap parts, which have been separated and reshaped where desirable, may become lodged in the cup-shaped openings of the die sections 50*a* and 52*a* and move upwardly with the die body D2, as the press completes its cycle of operation. Upward movement of the die body causes the pins 80 and 82 to contact stop surfaces in the press and force these members downwardly together with the ejector blades 72 and 74. The latter members displace the cut toe cap parts which fall downwardly at either side of the press and which may be received in suitable guide means for containing right and left toe cap parts. Resulting pairs of toe cap parts may then be processed in a separate press to form the flanged edges F1 and F2.

As earlier pointed out the parting blade construction shown in FIG. 17 may be used in place of the parting blade 62, shown in FIGS. 7 through 16, to engage the workpiece at two points of contact and consists in a blade member 62′ which is received in a manner earlier described in the upper frame part 22′. The blade 62′ has an edge 62*a* whose arc of curvature is chosen of a shape such that the edge 62*a* may engage the workpiece W at two spaced apart points of contact and apply pressure equally at two opposite sides of the workpiece. As press movement takes place, the workpiece becomes pressed against and accurately seated on convex surfaces corresponding to surfaces 32 and 34 of die body D1 in a suitable position for cutting to be initiated.

In FIGS. 18 – 20, inclusive, there is illustrated another modification of parting blade. As shown therein, a parting blade 62″ is made of a varying thickness and is mounted in a die body 64″, in turn secured in a frame 66″ of a press. This blade member 62″ is made with a relatively wide extremity which tapers to form a relatively narrow extremity. This tapered blade shape is arranged to move into a blade aperture 36″ of die body 38″ in a press frame 40″. When a workpiece W″ is engaged between these two die members 64″ and 38″ cutting takes place along converging lines of cutting Ca and Cb, and a wedge shaped piece of scrap is removed. A desirable result realized from thus removing a wedge-shaped piece of scrap is that it becomes possible to make one side of each separated box toe longer than the opposite side. This is advantageous for certain types of box toe shoe manufacture. Thus as shown in FIG. 20, the workpiece W″ when cut along the dotted line C*a* and C*b* will provide two toe cap parts T1 and T2. The toe cap T1 has a relatively long edge as TA and a relatively short edge TB. Similarly, the toe cap T2 will have a relatively long edge TC and a relatively short edge TD. By arranging these relatively long edges at the outer sides of shoes, there may be realized increased protection for the outside of the foot.

As earlier explained, the movement of the die parts may be varied with either die part D1 or D2 being the movable member in a press. It may, in addition, also be desired to modify the use of a parting blade in other ways as, for example, that shown in FIGS. 20, 21 and 22 wherein a parting blade member 100 may be secured in a die part 102 and moved upwardly into a parting blade receptacle located in the upper die body 104. In this case, shearing edges may, if desired, be employed to remove a narrow strip of scrap material which may be ejected through an opening 106, as shown in FIG. 21, or the parting blade in some instances may cut with a knife-edge without removal of scrap.

From the foregoing description of the invention, it will be apparent that an improved method of producing toe cap parts has been achieved with important advantages resulting. As earlier noted, box toes produced in accordance with the invention can be formed from a continuous strip of steel of five and a quarter inch width instead of five and three quarter inch width used with conventional presses in which drawing and parting are combined. The type of steel employed may be heavier, but in one preferred embodiment, may have a range of thicknesses of from 0.052 to 0.060 inches and can provide a box toe strength capable of withstanding loads ranging from 6,000 up to 10,000 pounds. In place of prior art presses of fifty to sixty ton rating, it is found that the method of the present invention may use smaller presses in a range of from forty to forty-five tons. It will also be observed that the method disclosed is readily adapted to an automatic processing in which handling of the workpieces by an operator may be replaced by automatic positioning means of well-known type.

We claim:

1. In a method of making box toes for safety shoes in which a metal sheet material is subjected to pressure to produce a bowl-shaped workpiece having a pair of mirror-imaged toe cap parts surrounded by irregular outer edge portions, the steps which include cutting the workpiece to provide separated toe cap parts, and then trimming said out edge portions from the toe cap portions as they become separated from one another by progressively exerting shearing forces therearound.

2. A method according to claim 1 in which inner and outer sides of the toe cap parts are simultaneously compressed between gauging surfaces to conform cut edges of the toe cap to a predetermined shape.

3. A method according to claim 1 in which pressure is exerted at spaced apart points along two opposite outer sides of the workpiece to locate the workpiece in a desired cutting position before the step of cutting is initiated.

4. A method according to claim 1 in which cutting is carried out by initiating shearing forces simultaneously at a plurality of separated points along the workpiece.

5. A method according to claim 1 in which the workpiece is cut along spaced apart lines of cutting.

6. A method according to claim 5 in which the toe cap parts are joined together by a connecting web portion, and cutting along the spaced apart lines of cutting removes the web portion.

7. In a method of making toe cap parts for safety shoes wherein a metal sheet material is subjected to pressure to produce a bowl-shaped workpiece in which is defined a pair of mirror imaged toe cap parts occurring in angularly opposed relation to one another and being surrounded by irregular outer edges, the steps which include cutting the workpiece to provide separated toe cap parts having cut edges which are angled rearwardly, then trimming the irregular outer edges from the toe cap portions as they become separated from one another and then compressing the angled cutting edges of the toe caps between gauging surfaces to conform the edges to a predetermined shape.

8. A method according to claim 7 in which pressure is exerted at spaced apart points along two opposite outer sides of the workpiece to locate the workpiece in a desired cutting position before the step of cutting is initiated.

9. In a method of making toe caps for safety shoes, the steps which include subjecting a sheet material to pressure to form a bowl-shape workpiece having defined therein mirror-imaged toe cap parts presenting convex surfaces surrounded by outer irregular edge parts, cutting the workpiece along spaced apart lines of cutting to separate the toe cap parts, exerting shearing forces along said irregular edge parts to trim off portions of said edge parts as the toe cap parts become separated from one another.

10. A method according to claim 9 in which the severed edges of the convex surfaces are compressed between gauging means to conform said edges to a predetermined shape.

11. A method according to claim 10 in which the trimmed edges of the toe cap parts are formed with flanges for gripping a shoe last.

12. Method of making box toes for safety shoes which comprises subjecting a metal sheet material to pressure to produce a bowl-shaped workpiece having an outer irregular edge of the sheet material extending therearound, locating the bowl-shaped workpiece between mating die surfaces, applying pressure to the workpiece at three separated points of contact to position the workpiece in centered relationship to one of the mating die surfaces, cutting the bowl-shaped workpiece along spaced apart lines of cutting to form separated toe cap parts, thereafter trimming outer edge portions of the separated toe cap parts by progressively exerting shearing forces therearound as the toe cap parts become separated, and then compressing the cut edges of the separated toe cap parts between gauging surfaces to conform the cut edges to a desired shape.

13. Apparatus for use in processing a drawn workpiece in which are defined toe cap parts connected together and occurring as mirror-images of one another in angularly opposed relationship, said apparatus including a die body constructed with convex toe cap mating sides for receiving the toe cap parts thereon, said die body being formed with a parting blade aperture extending medially between the toe cap mating sides, a second die body formed with concaved toe cap mating surfaces and a parting blade element located between the concaved mating surfaces and being movable into the parting blade aperture of the said first die body to cut the workpiece and provide two separated toe cap parts.

14. A structure as defined in claim 13 in which the parting blade is shaped with a centrally disposed projecting edge portion and relieved edge portions extending away from the projecting die portion at either side thereof for contacting the workpiece at separated points of contact and centering the workpiece on the said first die body.

15. Apparatus for use in processing a drawn workpiece in which are defined toe cap parts connected together and occurring as mirror-images of one another in angularly opposed relationship, said apparatus including a die body constructed with convex toe cap mating sides for receiving the top cap parts thereon, said die body being formed with a parting blade aperture extending medially between the toe cap mating sides, a second die body formed with concaved toe cap mating surfaces and a parting blade element located between the concaved mating surfaces and being movable into the parting blade aperture of the said first die body to cut the workpiece and provide two separated toe cap parts, said parting blade element being formed with a reversely curved shearing edge, said reversely curved shearing edge being constructed and arranged to contact the workpiece centrally and at opposite sides thereof to locate the workpiece in a secured centered position before the workpiece is cut.

16. A structure according to claim 15 in which shearing elements are provided at either side of the parting blade aperture and at their upper sides the shearing elements present convex gauging surfaces, and said parting blade element includes gauging portions located at either side of the parting blade in recessed relationship and being movable against cut edges of the workpiece to cooperate with the said gauging surfaces of the shearing elements and conform the cut edges to a desired shape.

17. A structure according to claim 13 in which said first die body is formed with a shearing edge extending continuously around a lower outer section of the die body in a position to receive edges of the workpiece and said second die body being formed with a complementary shearing edge extending therearound for engaging against the workpiece and trimming away said edge portions.

18. An apparatus for parting and trimming a drawn bowl-shaped workpiece in which are defined toe cap parts occurring in angularly opposed relationship to one another and having irregular edges extending therearound, said apparatus including frame means, a pair of mating die bodies received in the frame means, said frame means being constructed and arranged to support the die bodies in a reciprocating press in constantly registered relationship, one of said die bodies being formed with convex supporting surfaces against which inner sides of the said toe cap parts of the workpiece may be received, said die body at points between its convex surfaces being recessed to provide a parting blade aperture extending medially therethrough, shearing element mounted in the said die body along opposite sides of the aperture and presenting respective gauging surfaces at their upper sides, the other of said pair of mating die bodies being formed with shaped concaved surfaces and a parting blade element located centrally of the die body between the said concaved surfaces, said parting blade element having reversely curved cutting edges projecting outwardly therefrom in a position to move progressively into shearing relationship with edges of the shearing elements in the first die body to form separated toe cap parts, means located externally of the die bodies for trimming away irregular edges from the separated toe cap parts, and said parting blade element having at either side thereof guaging portions which are operative to move against the cut edges of the workpiece and compress said edges against the gauging surfaces of the said shearing elements in the said first die body to form the cut edges to a desired shape.

19. A structure according to claim 18 in which the said first die body includes vertically movable toe cap ejecting means.

20. A structure according to claim 13 in which the parting blade aperture forms a passageway through which a severed portion of the workpiece may be discharged.

* * * * *